US006612886B2

(12) United States Patent
Cole, Jr.

(10) Patent No.: US 6,612,886 B2
(45) Date of Patent: Sep. 2, 2003

(54) IN-LINE CABLE RETRIEVER

(75) Inventor: Jimmy R. Cole, Jr., Houston, TX (US)

(73) Assignee: Concord Technologies, Houston, TX (US)

( * ) Notice: Subject to any disclaimer, the term of this patent is extended or adjusted under 35 U.S.C. 154(b) by 0 days.

(21) Appl. No.: 10/087,393

(22) Filed: Mar. 1, 2002

(65) Prior Publication Data

US 2003/0045189 A1 Mar. 6, 2003

Related U.S. Application Data

(60) Provisional application No. 60/317,743, filed on Sep. 6, 2001.

(51) Int. Cl.[7] ..... B63B 22/00

(52) U.S. Cl. ..... 441/133; 114/245; 367/16

(58) Field of Search ..... 114/243, 245; 441/133; 367/16

(56) References Cited

U.S. PATENT DOCUMENTS

| | | | | |
|---|---|---|---|---|
| 3,931,608 | A | 1/1976 | Cole | 340/7 PC |
| 4,541,079 | A | 9/1985 | Thigpen | 367/19 |
| 4,711,194 | A | 12/1987 | Fowler | 114/245 |
| 4,823,325 | A | 4/1989 | Cole, Jr. | 367/20 |
| 5,214,612 | A | 5/1993 | Olivier et al. | 367/16 |
| 5,404,339 | A | 4/1995 | Cole, Jr. | 367/16 |
| 5,709,497 | A | 1/1998 | Zoch et al. | 403/24 |
| 5,949,214 | A | 9/1999 | Broussard et al. | 320/107 |
| 6,016,286 | A | 1/2000 | Olivier et al. | 367/17 |
| 6,019,652 | A | 2/2000 | Nielsen et al. | 441/133 |
| 6,142,092 | A | 11/2000 | Coupland | 114/331 |
| 6,188,646 | B1 | 2/2001 | Luscombe et al. | 367/154 |
| 6,239,363 | B1 | 5/2001 | Wooters | 174/47 |

OTHER PUBLICATIONS

Concord Technologies, LP, SRD–500 Recovery Device, http://www.concordtech.com/prod01.htm, 2 Pages, First published on the web in approximately 1998.

Concord Technologies, LP, Quick Latch Collar Assemblies, http://www.concordtech.com/Prod04.htm, 2 Pages, First published on the web in approximately 1998.

Concord Technologies, LP, SRD–1250 Recovery Device, http://concordtech.com/prod031.htm, 2 Pages, First published on the web in approximately 2000.

*Primary Examiner*—Jesus D. Sotelo
(74) *Attorney, Agent, or Firm*—Moser, Patterson & Sheridan, L.L.P.

(57) ABSTRACT

A retriever is provided for a marine seismic cable or other tool. The retriever first comprises a housing. Disposed within the housing is a canister for containing gas under pressure. An inflatable bag is fluidly connected to the gas canister within the housing. Gas is prohibited from exiting the gas canister and inflating the bag until hydrostatic pressure acting upon the retriever exceeds a designated amount. If the cable sinks to a certain depth within a water body, the corresponding hydrostatic pressure acting upon the cable will exceed the preset pressure level. An actuating mechanism is then actuated, causing gas to exit the gas canister and to inflate the inflatable bag. In one arrangement, a pop-open cover is provided on the housing. As the bag inflates, it acts to release the pop-open cover from the housing and to further inflate outside of the housing of the retriever. The inflated bag will cause the cable to be buoyantly lifted to the surface of the water body.

34 Claims, 2 Drawing Sheets

IN-LINE CABLE RETRIEVER

CROSS-REFERENCE TO RELATED APPLICATIONS

This application claims priority to a provisional patent application entitled "IN-LINE CABLE RETRIEVER," filed on Sep. 6, 2001 abandoned. That application carries Provisional Serial No. 60/317,743.

FIELD OF THE INVENTION

The present invention relates generally to marine seismic exploration. More specifically, the application pertains to streamer cables used in connection with marine seismic exploration. More particularly still, the invention relates to an in-line apparatus for retrieving a marine tool such as a seismic streamer cable, and a method for retrieving a cable using such an in-line apparatus.

BACKGROUND OF THE INVENTION

In the exploration of hydrocarbons offshore, seismic surveys are often employed. During seismic exploration, a plurality of airguns or other acoustic transmitters are actuated in a survey area. The airguns are typically towed behind a boat offshore. The airguns are fired to create a series of underwater acoustic pulses that generate seismic waves. The waves travel downward through the water, down to the earth's ocean bottom surface, and further downward through the various subsurface strata. Seismic waves reflect from the subsurface strata where they are then received by receivers placed in the water body. The receivers, known as "hydrophones," convert the physical seismic waves into electrical signals which are sent back to the ship for later processing. Data received from the receivers is processed in order to create a mapping of the underground formation.

Receivers such as hydrophones are carried through the water within cables referred to as "streamers." Typically, a seismic cable may be 3000 to 6000 meters long, or more. Marine seismic operations are conducted using one or more boats which tow the streamers through the water. The streamers incorporate the receivers at various intervals to define an array.

The streamers are typically designed with inherent buoyancy. The purpose is to maintain the receivers at a co-planar level within the water body. A separate cable-leveling device known as a "bird" may also be employed to assist in maintaining the cables at a uniform depth. In this respect, it is desirable to maintain the cables at a uniform designated level within the water while acoustic pulses are being received.

In order to maintain positive buoyancy in a cable, a jacket in the cable is filled with a lightweight fluid such as a high-paraffin oil. The fluid will endow the cable with a buoyant characteristic. The fluid, or buoyant medium, provides the cable with a designated weight comparable to that of the surrounding water, i.e., less than a specific gravity of one. It also assists in maintaining the cable's stable shape. Most importantly, the medium assists the cable at maintaining a substantially co-planar depth within the water. Additional background information concerning cable buoyancy is taught in U.S. Pat. No. 5,404,339 issued to Cole, Jr. on Apr. 4, 1995, which is incorporated in its entirety herein by reference.

Recently, various methods for maintaining a neutral buoyancy within a streamer cable have been developed. Examples include:

- U.S. Pat. No. 6,019,652 entitled "Buoyancy Adjustment." This patent was issued Feb. 1, 2000, to Nielsen, et al.
- U.S. Pat. No. 6,142,092 entitled "Depth Control Device." This patent was issued Nov. 7, 2000 to Coupland.
- U.S. Pat. No. 6,188,646 entitled "Hydrophone Carrier." This patent was issued Feb. 13, 2001 to Luscombe, et al.
- U.S. Pat. No. 6,239,363 entitled "Variable Buoyancy Cable." This patent was issued to Wooters on May 29, 2001.

It is not uncommon for a marine cable streamer, such as the streamers described in the above patents, to lose buoyancy. Reasons for buoyancy loss include a severance of the cable, a disconnect of the cable from the boat, punctures within the cable, or other accidental causes. Loss of buoyancy of the cable oftentimes means that the cable and associated sensors and other seismic tools will be lost in the ocean, or at least rendered ineffective for seismic operations.

In order to recover lost cables and seismic sensors, it is desirable to incorporate a retriever mechanism into a seismic cable streamer or other marine tool. Cable retrievers today typically consist of modules that have the facilities and ability to inflate a bladder with gas in order to raise the streamer to the surface in the event of a loss of buoyancy within the cable streamer itself. At the present time, all such retrievers are independent modules which are mounted onto the cable using clamps. An example of a seismic cable recovery device is the Concord Technologies SRD-500™, shown in FIG. 1. This is an automatic streamer recovery device 10 that aids in the recovery of seismic streamers 20 which have become severed from the towing vessel or have otherwise lost their buoyancy. The SRD-500 model includes quick-release mounting rings 14.

Seismic streamers are typically stored on a powered reel stack that is mounted on a seismic vessel. Each streamer is fed from the reel by hydraulic engines which rotate the reel in order to unspool the streamer. However, before a streamer cable can be deployed into the water, the deployment must be repeatedly interrupted in order to attach retrievers onto cable sections. Likewise, a cable cannot be spooled or otherwise retrieved onto the vessel without removing the retriever assemblies as they are recovered on deck. Thus, a significant amount of production time is lost in the attachment of the retriever modules during deployment of the seismic cables. Likewise, additional production time is lost by the detachment of the retriever modules when the seismic cables are retrieved.

The attachable/detachable structure 14 for retriever modules 10 and related tools, such as birds, has disadvantages. Streamers 12 can be up to six thousand meters in length and can require more than twenty retriever modules 10 for each streamer 12. Attaching and then detaching the external retriever modules 10 can be time consuming, increasing the cost of seismic surveys. Additionally, because the typical externally mounted pneumatic retriever modules 10 extend away from the seismic cable 12, they can become fouled on underwater objects and on other cables. In addition, externally mounted retriever modules 10 increase noise within the cable array as the streamers 12 are pulled through the water. For these reasons, there is a need for an improved design for a pneumatic retriever module to a marine seismic streamer cable or other marine tool.

There is further a need to provide a retriever that is an integral part of the cable streamer. Still further, there is a need to provide a retriever which does not need to be attached and detached from the cable line each time the cable is spooled or otherwise handled. Further still, there is a need for a retriever that minimizes acoustic noise generation from the retriever.

SUMMARY OF THE INVENTION

The present invention provides an apparatus for retrieving a seismic cable streamer or other marine tool, and a method for using the retriever assembly. The retriever of the present invention defines an in-line retriever, meaning it is placed in series with the cable streamer itself rather than being attached as an external module. Each section of cable includes electrically connected seismic sensors, such as hydrophones.

The novel in-line retriever of the present invention first comprises a cylindrical housing. The housing encloses all of the components required for independent operation of the retrieving device. These components first include a bladder which serves as an inflatable bag. The retriever further comprises a gas canister adapted to hold a quantity of compressed gas such as carbon dioxide or other appropriate non-explosive gas. A gas conduit connects the gas canister with a port in the inflatable bag in order to provide a fluid connection. The in-line retriever further comprises an actuating mechanism which causes pressurized gas to be released through the fluid conduit and into the inflatable bag. The actuating mechanism is pressure sensitive. In this respect, it is triggered by an increase in pressure due to hydrostatic head when the cable loses buoyancy and begins to sink deeper into the body of water.

A pop-open cover is provided on the housing. Inflation of the bag forces the cover on the housing to open, thereby releasing the bag from the housing and allowing further inflation. Complete inflation of the bag allows the cable to buoyantly rise to the surface in accordance with Archimedes principle and other laws of physics.

The housing preferably also provides couplings at either or both ends for physically connecting the retriever to the cable sections. The housing also permits through-passage of required electrical and/or optical transmission apparatus, e.g., hydrophone sensors, wiring, and analog-to-digital converters as may be utilized in marine seismic surveying operations. In this regard, the coupling are compatible with the electrical and optical functions of the cable, permitting the streamer to pass electrical, optical or other necessary signals through the retriever.

BRIEF DESCRIPTION OF THE DRAWINGS

So that the manner in which the above recited features of the present invention are attained and can be understood in more detail, a more particular description of the invention, briefly summarized above, may be had by reference to the embodiments thereof which are illustrated in the appended drawings. It is to be noted, however, that the appended drawings (FIGS. 2–4) illustrate only typical embodiments of this invention and are not to be considered limiting of its scope, for the invention may admit to other equally effective embodiments.

DETAILED DESCRIPTION OF THE PREFERRED EMBODIMENT

Figure 1:
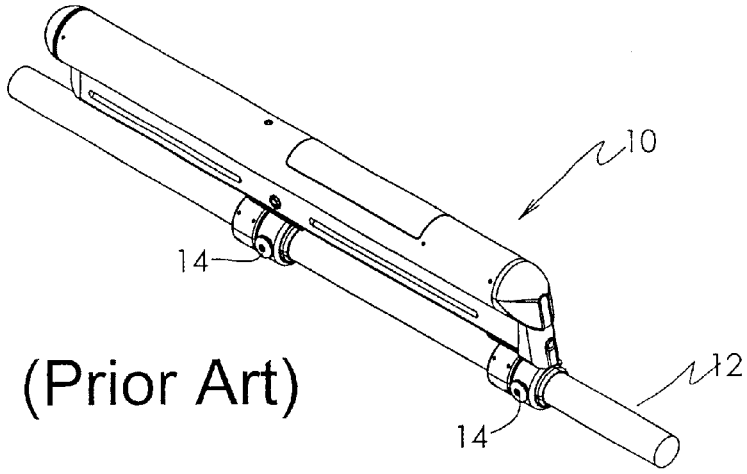
Fig. 1 (Prior Art)
FIG. 1 is a perspective view of a prior art retriever device attached to a seismic cable streamer section. The retriever module is mounted onto the cable externally by the use of clamps.
Figure 2:
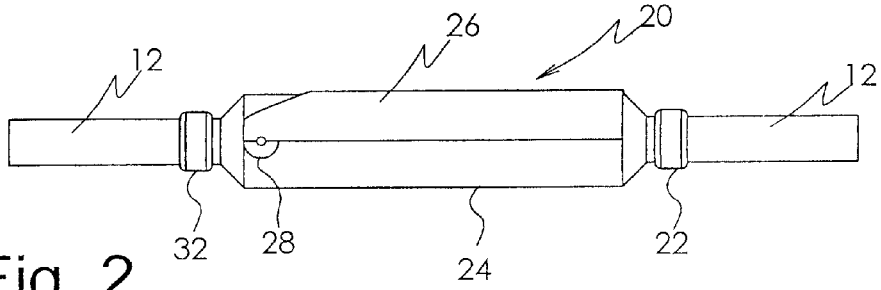
FIG. 2 presents a side view of an in-line buoyant retrieving device of the present invention. Unlike the prior art device of FIG. 1, the retrieving device of the present invention resides in series with the streamer cable itself.

FIG. 2 presents a side view of a retriever device 20 of the present invention. The retriever 20 is designed to be "in-line," meaning that it resides in series within a cable 12 such as a marine seismic cable. As used herein, the term "in-line" also refers to the fact that the axis of the cable 12 passes through the length of the retriever 20. Thus, the retriever 20 may be incorporated into the elongated cable string by using couplings 32. Alternatively, and as shown in FIG. 2, the retriever may be a separate device which is placed onto facing ends of the cable 12 by using couplings 32. The couplings 32 are used to place the retriever 20 in series with the cable 12 so as to make up one continuous cable of a seismic streamer array (complete array not show). It is understood that each section of cable includes a plurality of electrically connected seismic sensors, such as hydrophones.

Figure 3:
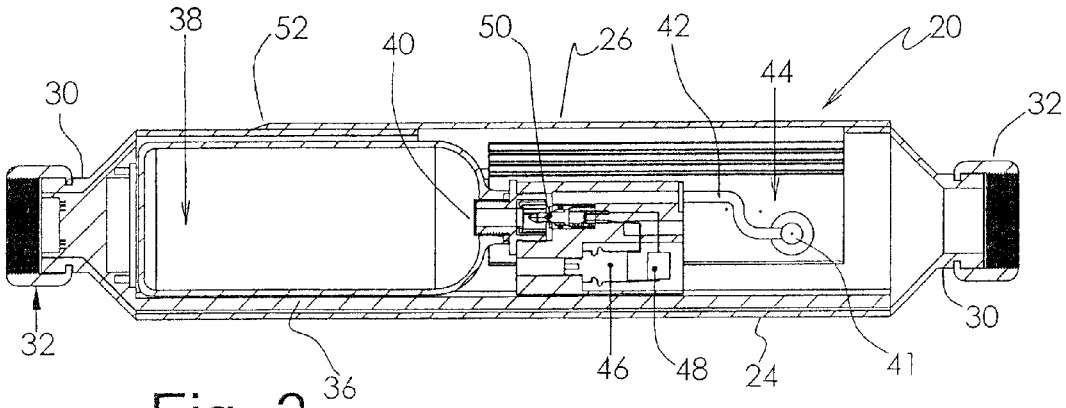
FIG. 3 is a side cross-sectional view of an in-line buoyant retrieving device of the present invention.

FIG. 3 provides a cross-sectional side-view of a retriever 20 of the present invention. The cross-sectional view of FIG. 3 provides greater details of components of the retriever device 20. The retriever first comprises a housing 24. The housing 24 is substantially cylindrical in configuration. The housing 24 is preferably fabricated from titanium or other material of sufficient strength to withstand the stresses of spooling.

The housing 24 terminates at opposite ends within a reduced diameter stub tube 30. The stub tube 30 receives the coupling 32. In one aspect, the coupling 32 defines a rotatably mounted collar for providing a sealed connection between the retriever 20 and an attached cable section 12. A common male-to-female electrical connector (details not shown) is included within the coupling 32 for placing the retriever 20 and the attached cable section 12 in electrical communication. Further, a suitable electrical conduit 36 is placed within the housing 24 in order to transmit electrical signals, including optical signals, through the retriever 20. In this way, a continuous and uninterrupted channel for electrical, optical, or other necessary signals is provided through the retriever 20.

Incorporated into the cylindrical housing 24 is a cover 26. The cover includes at least one releasable attachment 52. The cover 26 defines any surface which permits release of the bag 44 from within the housing 24 upon inflation. Preferably, the cover 26 is an elongated arcuate metal or plastic plate having opposite ends. A releasable connection 52 is provided at one end. At the opposite end, the cover 26 pivots about a hinge mount 28. In this manner, the cover 26 defines a "pop-open cover" which is popped-open due to force from within the housing when the bag 44 is inflated.

Interior to the housing 24 is a gas canister 38. The canister 38 is fabricated from a material of sufficient strength to safely contain a sufficient quantity of gas under pressure. Preferably, the canister 38 is fabricated from a metal alloy. The gas canister 38 is adapted to hold a quantity of compressed gas. A typical quantity of gas pressure may be stored at 800 psi, for example. The gas is any appropriate non-explosive gas, such as carbon dioxide or air. Preferably a non-corrosive gas is used.

Preferably, the gas canister 38 resides within the housing 24 at one end. The gas canister 38 is sealed at a membrane 40. The membrane 40 separates gas within the container from a gas conduit 42. Any breaking of the membrane 40 releases gas from the canister 38. A sufficient quantity of gas is released from the canister 38 so as to raise the retriever 20 and the attached weight of cable 12 to the surface in the event of a loss of buoyancy within the cable 12.

The retrieving device 20 also comprises a bladder 44. The bladder defines an inflatable bag 44 which receives gas from the gas container 38. The inflatable bag 44 is maintained within the housing 24 in a folded manner before it is actuated. The inflatable bag 44 is fabricated from a durable, airtight material such as reinforced plastic.

A gas conduit 42 provides fluid communication between the gas container 38 and the inflatable bag 44. At one end, the gas conduit 42 sealingly connects to the inflatable bag 44 at a port 41. At the opposite end, the gas conduit 42 sealingly connects to an outlet for the gas canister 38.

As noted, gas is initially prohibited from escaping from the gas canister 38 by a membrane 40. The membrane 40 is positioned proximate to the outlet of the gas canister 38. The membrane 40 may be positioned within the gas conduit 42, but preferably is a part of the canister 38 insert. Thus, in the retriever device's 20 unactuated state, the membrane 40 prevents gas from exiting the gas canister 38 and entering the inflatable bag 44 via gas conduit 42.

The retrieving device 20 of the present invention further comprises an actuating mechanism. The actuating mechanism causes gas to exit the gas canister 38 and to enter the inflatable bag 44. In the arrangement shown in FIG. 3, the actuating mechanism first includes a switch 46. The switch 46 is preferably a single pole, normally open electrical switch that is pre-set to complete an electrical circuit when exposed to a pre-determined hydrostatic pressure. In the preferred arrangement, the pressure sensor and switch are incorporated together as a pressure transducer 46. An example is a TI® pressure transducer which operates electromechanically. However, other pressure-responsive switches may be used in the present invention, including a digitally derived pressure switch.

In operation, the switch 46 acts in response to a pressure sensor. If a cable 12 with an attached retriever 20 should begin to sink, the increase in hydraulic pressure will be sensed by the switch 46, causing it to be actuated. The switch 46 may be set for any desired depth. When the pressure switch 46 is activated, electrical power from a battery 48, preferably a 2.3 volts lithium cell, detonates an explosive penetrator 50. The penetrator 50, in turn, bursts the membrane 40. Thus, the actuating mechanism in one aspect comprises a pressure-sensitive switch 46, and a penetrator 50 for providing fluid communication between the gas canister 38 and the inflatable bag 44. However, other actuating mechanisms may be employed.

With the penetration of the membrane 40, gas from the canister 38 is released into the gas conduit 42. From there, gas travels through the port 41 and into the bag 44, thereby inflating the bag. As the bag inflates, mechanical pressure is created within the housing 24 against the pop-open cover 26. The releasable connection 52 holding the cover 26 to the housing 24 is broken. The cover 26 is then pivotally lifted off of the housing 24 and out of the way of the bag 44.

Figure 4:
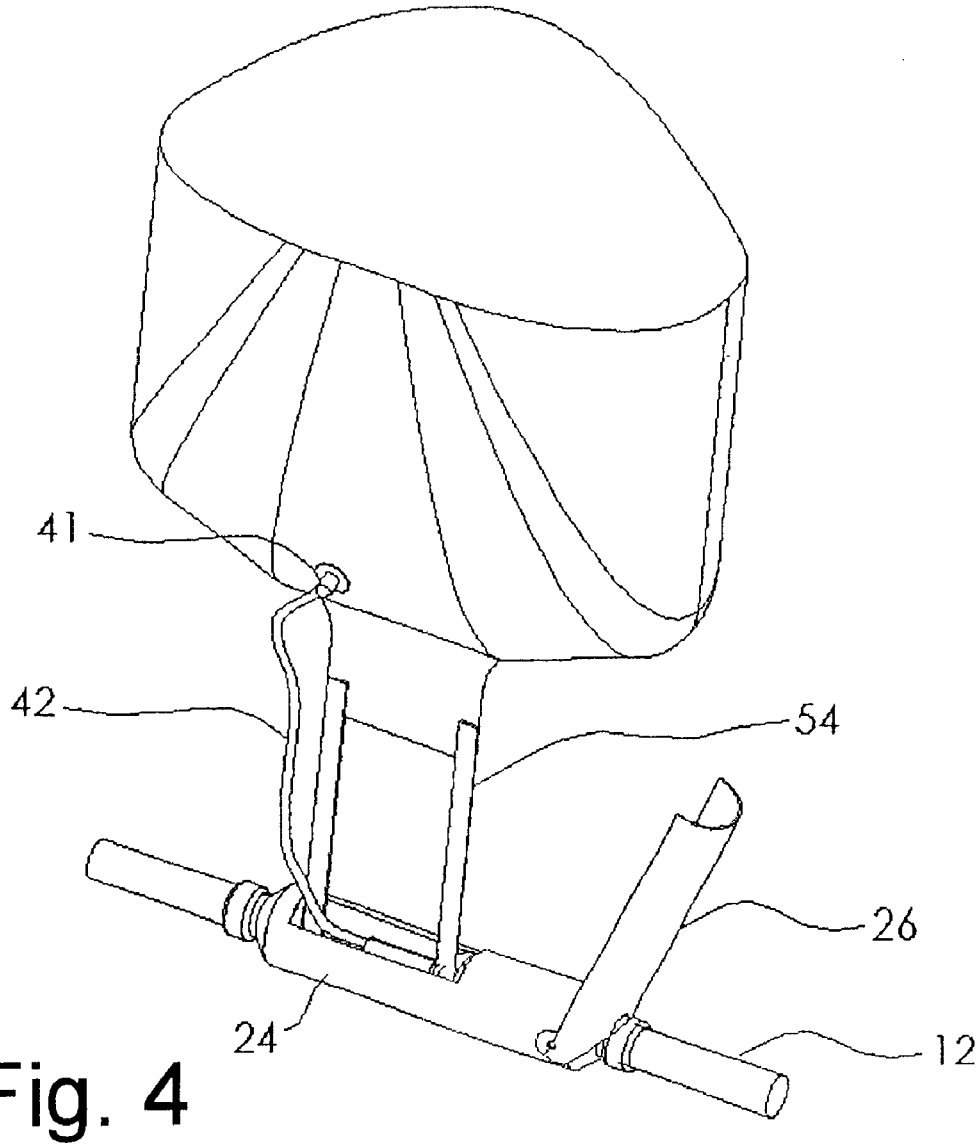
FIG. 4 is a perspective view of an in-line retrieving device, after it has been deployed.

FIG. 4 depicts the inflatable bag 44 having been inflated outside of the housing 24. Visible in FIG. 4 is the pop-open cover 26, having been pivotally lifted off of the housing 24. Also visible are tethers 54 connecting the inflatable bag 44 to the housing 24. In the arrangement shown, the tethers 54 are connected to the gas canister 38 of the housing 24. Finally, the fluid conduit 42 is visible in FIG. 4, maintaining fluid communication between the inflatable bag 44 and the gas canister 38. In this manner, the inflatable bag 44 remains under pressure so as to buoyantly lift the retriever 20 to the surface of the body of water with the cable 12.

As previously mentioned, retrievers are typically used to lift cables to the surface of the water in the event of damage to or loss of the cable 12. When a cable 12 begins to sink, it experiences an increase in pressure of about 1 psi for each 2.2 feet of submergence. Streamers 12 are normally towed beneath the surface at a depth of 20 to 60 feet, which equates to 9 psi to 28 psi, approximately, of hydrostatic pressure. Occasionally, a cable 12 is commanded to submerge to depths down to 100 feet in order to avoid ships that may pass over the towed cable 12. Therefore, it is preferred that the switch 46 be set to activate only when a cable 12 has sunk to a depth of at least 100 feet. In this respect, the switch 46 would, preferably, be set to activate at approximately 45 psi. However, the scope of the present invention is not limited to any particular pressure setting.

As described, the retriever 20 of the present invention is an independent device that contains all components required to provide a positive buoyancy when it is subjected to an over-pressure greater than has been selected. Integration of components and operational sequence in one embodiment are as follows:

The sealed canister 38 of compressed gas is connected to the folded flotation bag 44. A gas conduit is utilized to provide fluid communication between the canister 38 and the bag 44. The electrically actuated penetrator 50 is mounted within this pneumatic circuit proximate to the gas conduit 42. The pressure switch 46, battery 48 and penetrator 50 are then connected electrically as a series circuit. The flotation bag 44 is folded within the housing 24 and contained by the pop-open cover 26. When the hydrostatic pressure acting upon the retriever device 20 exceeds a selected amount, the contacts in the switch 46 shut, thereby completing the electrical circuit. This, in turn, causes the explosive penetrator 50 to activate. The penetrator 50 ruptures the membrane 44 on the gas canister 38. Compressed gas then exits the canister 38, passes through the gas conduit 42, and enters the inflatable bag 44.

As the inflatable bag 44 is inflated, its volume expands. The bag expansively contacts the inside surface of the pop-open cover 26. Ultimately, the releasable connection 52 for the cover 26 is released, causing the cover 26 to open. Gas continues to flow into the bag 44 until pressure is equalized between the bag 44 and the canister 38. The inflated bag 44 creates a positive buoyancy force which overcomes the hydrostatic pressure of the water.

While the foregoing is directed to embodiments of the present invention, other and further embodiments of the invention may be devised without departing from the basic scope thereof, and the scope thereof is determined by the claims that follow.

What is claimed is:

1. A retriever for a marine tool, the retriever comprising:

a housing having a first end and a second end, at least one of said first and second ends being coupled in-line with the marine tool;

a gas canister within said housing adapted to retain a quantity of pressurized gas;

an inflatable bag within said housing; and an actuator mechanism for creating fluid communication between said gas canister and said inflatable bag such that said inflatable bag is inflated at a sensed pressure in response to a selected water depth.

2. The retriever of claim 1, wherein said marine tool is a seismic cable.

3. The retriever of claim 2, wherein said housing is substantially cylindrical in configuration.

4. The retriever of claim 2, further comprising:

a gas conduit for placing said gas canister and said inflatable bag in fluid communication, said gas conduit having a first end sealingly connected to said gas canister, and a second end sealingly connected to a port within said inflatable bag;

a membrane for prohibiting the flow of gas from said canister through said gas conduit; and wherein said actuator mechanism acts upon said membrane upon activation so as to open said membrane and to allow gas to travel from said gas canister through said gas conduit and into said inflatable bag.

5. The retriever of claim 4, wherein said housing further comprises a pop-open cover, said pop-open cover opening due to the force of gas inflating said inflatable bag so as to allow said bag to exit said housing in response to inflation.

6. The retriever of claim 5, wherein said pop-open cover comprises:

an arcuate plate having a first end and a second end, said pop-open cover being disposed over said inflatable bag;

a pivoting connection at said first end of said pop-open cover for pivotally connecting said pop-open cover with said housing; and a connector for releasably connecting said second end of said pop-open cover from said housing.

7. The retriever of claim 5, wherein said actuator mechanism comprises:

a pressure sensitive switch; and a penetrator for penetrating through said membrane.

8. The retriever of claim 7, wherein said membrane is proximate to said first end of said gas conduit.

9. The retriever of claim 7, wherein said pressure sensitive switch defines a pressure transducer.

10. The retriever of claim 9, wherein said pressure transducer is battery powered.

11. The retriever of claim 9, wherein said penetrator defines an explosive penetrator actuated in response to actuation of said pressure transducer.

12. The retriever of claim 7, wherein each of said first and second ends of said housing comprises a coupling for connecting said retriever to a section of seismic cable.

13. The retriever of claim 12, wherein each of said first and second ends of said housing further comprises electrical connectors between said retriever and said section of seismic cable; and wherein said retriever further comprises an electrical conduit within said housing for providing a continuous channel for electrical signals through said retriever during marine seismic operations.

14. An in-line retriever for a marine seismic streamer, the streamer having electrically connected seismic sensors therein, the in-line retriever comprising:

a substantially cylindrical housing having a first end and a second end, each of said first and second ends of said housing comprising a coupling for connecting said retriever in-line to a section of seismic streamer;

a gas canister disposed within said housing adapted to retain a quantity of pressurized gas;

an inflatable bag within said housing;

a gas conduit for placing said gas cylinder and said inflatable bag in fluid communication, said gas conduit having a first end sealingly connected to said canister, and a second end sealingly connected to said inflatable bag;

a membrane disposed within the path of fluid communication between said gas canister and said gas conduit;

an actuator mechanism for penetrating said membrane at a sensed pressure in response to a selected water depth, thereby creating fluid communication between said gas canister and said inflatable bag such that said inflatable bag is inflated; and a pop-open cover disposed on said housing, said pop-open cover opening due to the force of gas inflating said inflatable bag so as to allow said bag to exit said housing in response to inflation.

15. The in-line retriever of claim 14, wherein said pop-open cover comprises:

an arcuate plate having a first end and a second end, said pop-open cover being disposed over said inflatable bag;

a pivoting connection at said first end of said pop-open cover for pivotally connecting said pop-open cover with said housing; and a connector for releasably connecting said second end of said pop-open cover from said housing.

16. The in-line retriever of claim 15, wherein said actuator mechanism comprises:

a battery-powered pressure-sensitive switch defining a pressure transducer; and an explosive penetrator for penetrating through said membrane in response to a signal from said pressure-sensitive switch.

17. The in-line retriever of claim 16, wherein said membrane is proximate to said first end of said gas conduit.

18. The in-line retriever of claim 17, wherein each of said first and second ends of said housing further comprises electrical connectors between said retriever and said section of seismic cable; and wherein said retriever further comprises an electrical conduit within said housing for providing a continuous channel for electrical signals through said retriever during marine seismic operations.

19. The in-line retriever of claim 18, further comprising a tether for connecting said inflatable bag to said housing.

20. A method of retrieving a marine seismic cable, the cable having electrical conductors therein, comprising the steps of:

mounting at least one retriever in-line in the marine seismic cable, the retriever conducting electrical signals from the cable therethrough;

detecting hydraulic pressure on the buoyancy device indicative of water depth; and upon detecting a predetermined pressure, activating the retriever, thereby causing the cable to rise substantially to the surface of the water body.

21. The method of retrieving a marine seismic cable of claim 20, further comprising the step of retrieving the retriever and connected cable.

22. The method of retrieving a marine seismic cable of claim 21, wherein said retriever comprises:

a housing having a first end and a second end, at least one of said first and second ends being coupled in-line with the seismic cable;

a gas canister within said housing adapted to retain a quantity of pressurized gas;

an inflatable bag within said housing; and an actuator mechanism for creating fluid communication between said gas canister and said inflatable bag such that said inflatable bag is inflated at a sensed pressure in response to a selected water depth.

23. The method of retrieving a marine seismic cable of claim 22, wherein said housing is substantially cylindrical in configuration.

24. The method of retrieving a marine seismic cable of claim 23, wherein said retriever further comprises:

a gas conduit for placing said gas canister and said inflatable bag in fluid communication, said gas conduit having a first end sealingly connected to said gas canister, and a second end sealingly connected to a port within said inflatable bag;

a membrane for prohibiting the flow of gas from said canister through said gas conduit; and wherein said actuator mechanism acts upon said membrane upon activation so as to open said membrane and to allow gas to travel from said gas canister through said gas conduit and into said inflatable bag.

25. The method of retrieving a marine seismic cable of claim 24, wherein said housing further comprises a pop-open cover, said pop-open cover opening due to the force of gas inflating said inflatable bag so as to allow said bag to exit said housing in response to inflation.

26. The method of retrieving a marine seismic cable of claim 25, wherein said pop-open cover comprises:

an arcuate plate having a first end and a second end, said pop-open cover being disposed over said inflatable bag;

a pivoting connection at said first end of said pop-open cover for pivotally connecting said pop-open cover with said housing; and a connector for releasably connecting said second end of said pop-open cover from said housing.

27. The method of retrieving a marine seismic cable of claim 25, wherein said actuator mechanism comprises:

a pressure sensitive switch; and a penetrator for penetrating through said membrane.

28. The method of retrieving a marine seismic cable of claim 27, wherein said membrane is proximate to said first end of said gas conduit.

29. The method of retrieving a marine seismic cable of claim 27, wherein said pressure sensitive switch defines a pressure transducer.

30. The method of retrieving a marine seismic cable of claim 29, wherein said pressure transducer is battery powered.

31. The method of retrieving a marine seismic cable of claim 29, wherein said penetrator defines an explosive penetrator actuated in response to actuation of said pressure transducer.

32. The method of retrieving a marine seismic cable of claim 27, wherein each of said first and second ends of said housing comprises a coupling for connecting said retriever to a section of seismic cable.

33. The method of retrieving a marine seismic cable of claim 32, wherein each of said first and second ends of said housing further comprises electrical connectors between said retriever and said section of seismic cable; and wherein said retriever further comprises an electrical conduit within said housing for providing a continuous channel for electrical signals through said retriever during marine seismic operations.

34. The method of retrieving a marine seismic cable of claim 25, wherein said predetermined pressure is the hydrostatic pressure acting upon the cable in a body of water at a depth of approximately 100 feet.

* * * * *